US008066485B1

(12) United States Patent
Liang

(10) Patent No.: US 8,066,485 B1
(45) Date of Patent: Nov. 29, 2011

(54) TURBINE BLADE WITH TIP SECTION COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 456 days.

(21) Appl. No.: 12/466,578

(22) Filed: May 15, 2009

(51) Int. Cl.
*F01D 5/18* (2006.01)

(52) U.S. Cl. ..... 416/97 R; 416/95; 416/93 R; 416/224; 416/228; 416/241 R; 415/115; 415/116

(58) Field of Classification Search ..... 415/115, 415/116, 173.1, 178; 416/95, 96 A, 96 R, 416/97 R, 224, 228, 241 B, 241 R
See application file for complete search history.

(56) References Cited

U.S. PATENT DOCUMENTS

| | | | | | |
|---|---|---|---|---|---|
| 3,781,129 | A * | 12/1973 | Aspinwall | 416/97 R |
| 4,589,823 | A * | 5/1986 | Koffel | 416/92 |
| 4,940,388 | A * | 7/1990 | Lilleker et al. | 416/97 R |
| 5,096,379 | A * | 3/1992 | Stroud et al. | 416/97 R |
| 5,356,265 | A * | 10/1994 | Kercher | 416/97 R |
| 5,846,057 | A * | 12/1998 | Ferrigno et al. | 416/241 R |
| 6,364,608 | B1 * | 4/2002 | Brainch et al. | 416/97 R |
| 6,494,678 | B1 * | 12/2002 | Bunker | 416/97 R |
| 6,514,037 | B1 * | 2/2003 | Danowski et al. | 415/115 |
| 7,021,896 | B2 * | 4/2006 | Dodd | 416/97 R |
| 7,249,934 | B2 * | 7/2007 | Palmer et al. | 416/97 R |
| 7,845,908 | B1 * | 12/2010 | Liang | 416/97 R |
| 8,011,889 | B1 * | 9/2011 | Liang | 416/97 R |
| 2002/0182074 | A1 * | 12/2002 | Bunker | 416/97 R |
| 2004/0076519 | A1 * | 4/2004 | Halfmann et al. | 416/97 R |
| 2004/0151587 | A1 * | 8/2004 | Cunha et al. | 416/97 R |
| 2006/0257256 | A1 * | 11/2006 | Eastman et al. | 416/96 R |
| 2007/0286729 | A1 * | 12/2007 | Kopmels | 416/97 R |
| 2009/0175733 | A1 * | 7/2009 | Poon et al. | 416/97 R |
| 2009/0180861 | A1 * | 7/2009 | Trindade et al. | 415/115 |
| 2010/0080711 | A1 * | 4/2010 | Page et al. | 416/97 R |

* cited by examiner

*Primary Examiner* — Michael Lebentritt
(74) *Attorney, Agent, or Firm* — John Ryznic

(57) ABSTRACT

A turbine rotor blade with a single tip rail on the suction side of the blade tip, and in which the pressure side tip edge includes a row of trench film slots that each having side walls that are open on the pressure side wall and extend onto the tip floor and have side walls with a curvature toward the trailing edge of the blade tip. The trench film slots also have a curved inboard surface and a curved outboard surface in which the inboard surface curvature is less than the outboard surface curvature. The tip rail includes a slot opening onto the top surface and extending the length of the tip rail with a row of metering and cooling holes opening into the slot. The metering and cooling holes have a curvature toward the pressure side edge of the tip floor to increase a heat transfer rate form the metal.

16 Claims, 8 Drawing Sheets

TURBINE BLADE WITH TIP SECTION COOLING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade tip section with cooling and sealing.

2. Description of the Related Art including information disclosed under 37 CFR 1.97 and 1.98

A gas turbine engine, especially an industrial gas turbine (IGT) engine, includes a turbine section with a number of rows or stages or rotor blades and stator vanes to react with a hot gas flow to power the engine. The efficiency of the engine can be increased by passing a higher temperature gas flow into the turbine. However, the highest turbine inlet temperature is limited to the airfoil materials and the cooling capability of the first stage blades and vanes. An improvement in the material properties or to provide better cooling to allow for higher temperatures will allow for higher engine efficiency.

Another problem with high temperature exposure to the turbine air foils is from erosion due to the hot gas flow acting on a section of the blade tip that is not adequately cooled. A high temperature turbine blade tip section heat load is a function of the blade tip leakage flow. A high leakage flow will induce high heat load onto the blade tip section, leading to increased cooling ability. Thus, blade tip section sealing and cooling must be addressed as a single problem. In the prior art, a turbine blade tip includes a squealer tip rail which extends around the perimeter of the airfoil flush with the airfoil wall to form an inner squealer pocket. The main purpose of incorporating a squealer tip into a blade design is to reduce the blade tip leakage and also to provide rubbing capability for the blade tip against an inner surface of the engine shroud that forms a blade outer air seal or BOAS. The tip rail provides for a minimum amount of material that contacts the shroud surface while minimizing the gap.

In general, film cooling holes are positioned along the airfoil pressure side wall near the tip section and extend from the leading edge to the trailing edge to provide edge cooling for the tip rail at the inner portion of the squealer pocket to provide for additional cooling for the squealer tip rail. Secondary hot gas leakage flow (shown by the arrows over the tip in FIG. 1) migrates around the blade tip section. The vortex flow from the blade suction side is shown by the spiraling arrow flow in FIG. 1. The film holes in the prior art of FIGS. 2 and 4 are drilled into the airfoil surface just below the tip edges on the pressure side wall and the suction side wall and extend from the leading edge to the trailing edge. Also, convection cooling holes are formed along the tip rail at an inner portion of a squealer pocket to provide additional cooling for the squealer tip rail. Since the blade tip region is subject to severe secondary flow, a large number of film cooling holes and cooling flow is required for the cooling of the blade tip periphery.

FIG. 2 shows a prior art blade with the pressure side tip section having a row of pressure side film cooling holes that open just below the tip edge and extend from the leading edge region to the trailing edge region. FIG. 3 shows the film hole breakout pattern of these film holes.

FIG. 4 shows the prior art turbine blade with cooling for the blade suction side tip rail arrangement. The suction side blade tip rail is subject to heating from three exposed sides. Cooling of the suction side squealer tip rail by means off a row of discharge film cooling holes located along the blade suction side peripheral and at the bottom of the squealer floor becomes insufficient. This is primarily due to the combination of tip rail geometry and the interaction of the hot gas secondary flow mixing. The effectiveness induced by the suction side film cooling and the tip section convective cooling holes is very limited.

The blade squealer tip rail is subject to heating from the three exposed sides which includes heat load from the airfoil hot gas side surface of the tip rail, heat load from the top portion of the tip rail, and heat load from the back side of the tip rail. Cooling of the squealer tip rail by means of discharge row of film cooling holes along the blade pressure side and suction side periphery and conduction through the base region of the squealer is insufficient. This is primarily due to the combination of squealer pocket geometry and the interaction of hot gas secondary flow mixing. The effectiveness induced by the pressure side film cooling and the tip section convection cooling holes is very limited. Also, a TBC is normally used ion the industrial gas turbine airfoil for the reduction of blade metal temperature. However, applying the TBC around the blade tip rail without effective backside convection cooling may not reduce the blade tip rail metal temperature. FIG. 5 shows the state of the art prior art blade tip section cooling design. This blade includes the pressure side wall 11 with a pressure side tip film cooling hole 12 and a TBC applied over the wall 11, a pressure side tip rail 15, a suction side wall 21 with a suction side film cooling hole 22, a TBC 13 applied on the suction side wall 21, and a suction side tip rail 25. The blade tip is formed by a tip floor 16 with a TBC 13 on it as well that even extends up along the inner surfaces of the two tip rails 15 and 25. The blade forms a cooling air supply channel 17 that is connected to two rows of tip cooling holes with one row next 18 to the pressure side tip rail 15 and the second row 19 next to the suction side tip rail 25. The two tip rails 15 and 25 include tip caps that form a seal with a BOAS 27 on the stationary casing of the engine.

BRIEF SUMMARY OF THE INVENTION

It is an object of the present invention to provide for a turbine rotor blade with a single suction side tip rail with cooling and sealing of the tip.

It is another object of the present invention to provide for a turbine rotor blade with a tip rail on the suction side that creates a cooling air flow vortex to trap the cooling flow longer than in the prior art in order to provide better cooling for the tip rail.

It is another object of the present invention to provide for a turbine rotor blade with a tip rail in which the blade tip section cooling air flow and blade leakage flow is lower than the prior art blade tips.

It is another object of the present invention to provide for a turbine rotor blade with a tip rail that has a higher efficiency due to low blade leakage flow.

It is another object of the present invention to provide for a turbine rotor blade with a tip rail that has a reduced section heat load due to a low leakage flow in order to increase the blade useful life.

DETAILED DESCRIPTION OF THE INVENTION

Figure 1:
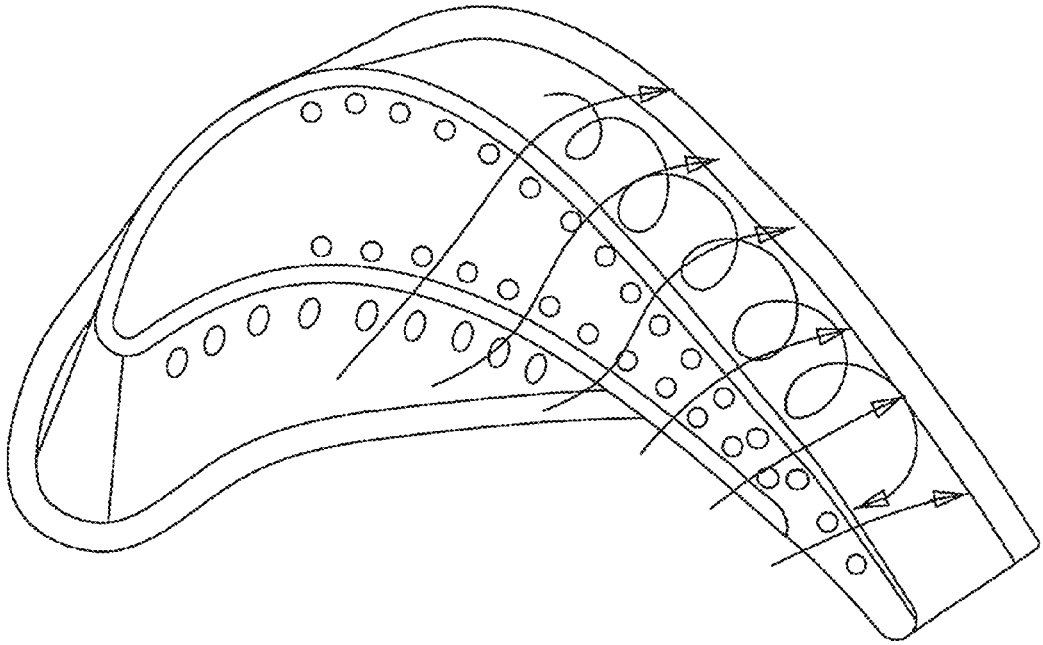
Fig 1 Prior Art
FIG. 1 shows a top view of a prior art blade tip with the secondary leakage flow and the vortex flow from the blade suction side.
Figure 2:
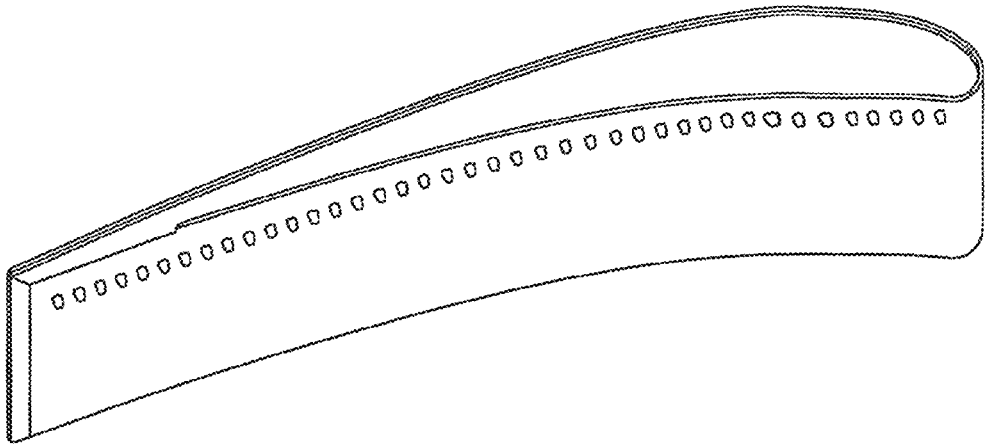
Fig 2 Prior Art
FIG. 2 shows the prior art blade tip from the pressure side with a row of film cooling holes just beneath the tip edge.
Figure 3:
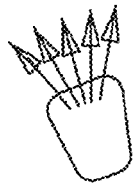
Fig 3 Prior Art
FIG. 3 shows the film hole breakout shape of the film holes in FIG. 2.
Figure 4:
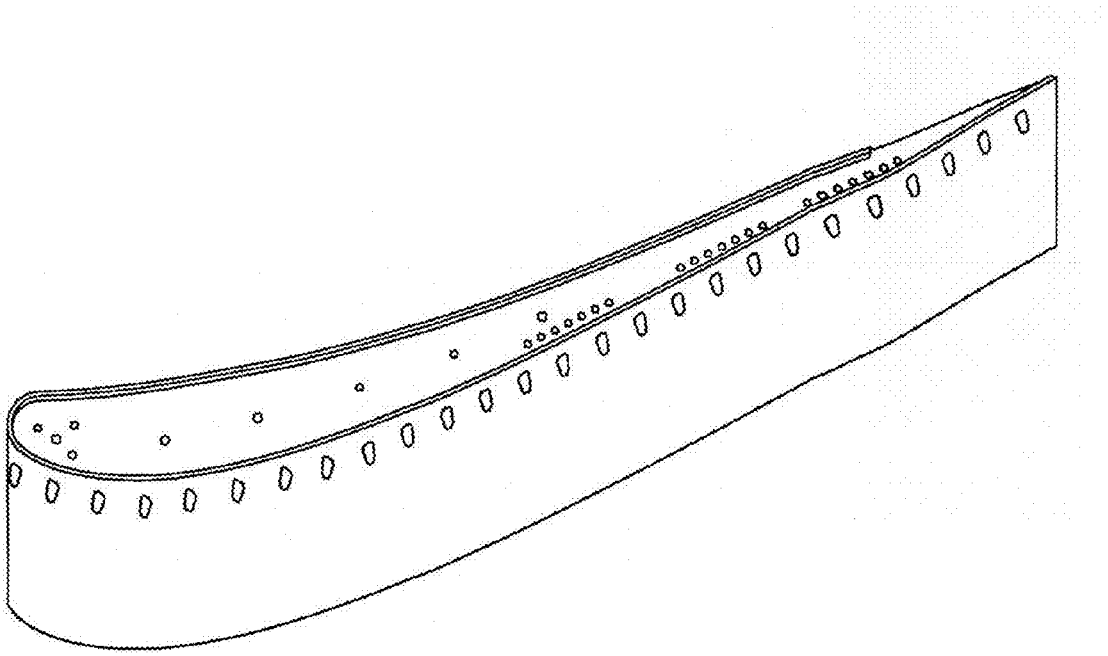
Fig 4 Prior Art
FIG. 4 shows the prior art blade tip from the suction side with a row of film cooling holes just beneath the tip edge.
Figure 5:
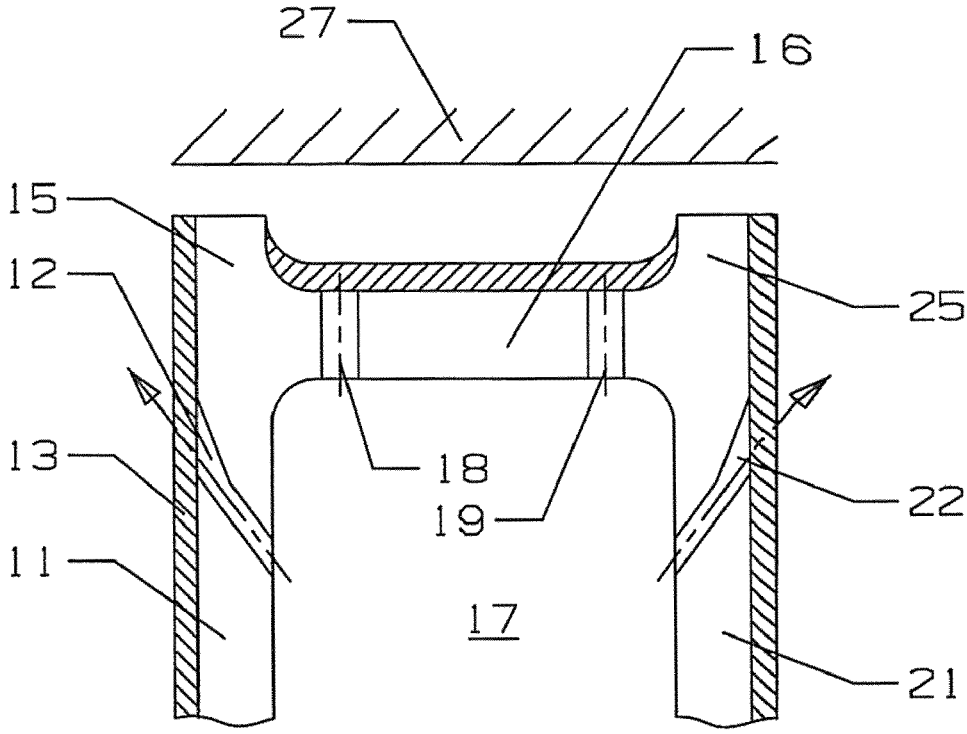
Fig 5 Prior Art
FIG. 5 shows a cross section side view of the prior art blade tip with the cooling hole arrangement.
Figure 6:
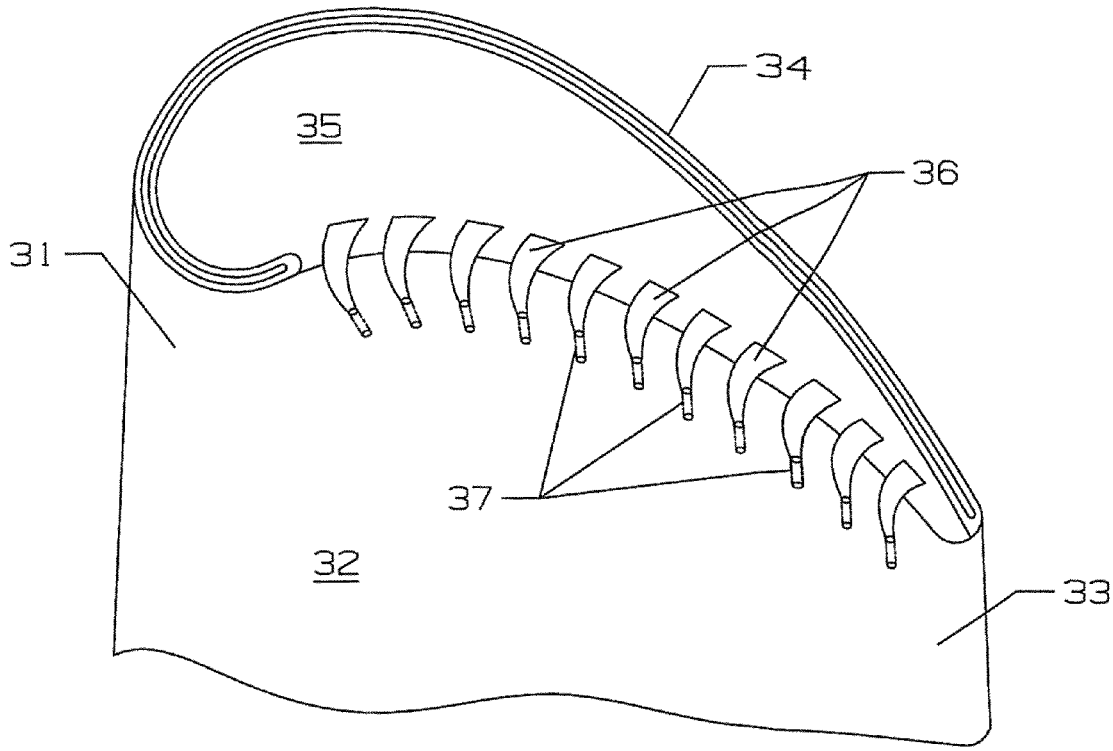
FIG. 6 shows a perspective view of the blade tip of the present invention from the suction side.
Figure 7:
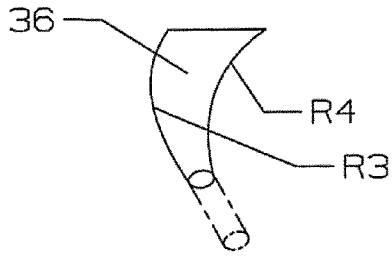
FIG. 7 shows a cross section side view of one of the cooling holes on the pressure side wall tip edge of the present invention.

The turbine rotor blade with the tip cooling circuit of the present invention is shown in FIGS. 6-13 where FIG. 6 shows the blade tip from a top view on the pressure wall side and includes a leading edge 31, a pressure side wall 32, a trailing edge 33*a* suction side tip rail 34 that extends from the trailing edge and around the leading edge 31 and ends just down from the leading edge region on the pressure side wall 32 as seen in FIG. 6. A tip floor 35 closes off the blade tip and forms a squealer pocket with the tip rail 34. A row of pressure side trenches 36 extends along the pressure side wall and the tip between the ending of the tip rail 34 and the trailing edge 33. Each trench 36 is connected to a cooling air supply channel formed within the body of the airfoil by a metering hole 37. Each of the trenches 36 each are formed by an upstream side wall with a radius of curvature of R3 and a downstream side wall with a radius of curvature of R4 as seen in FIG. 7.

Figure 8:
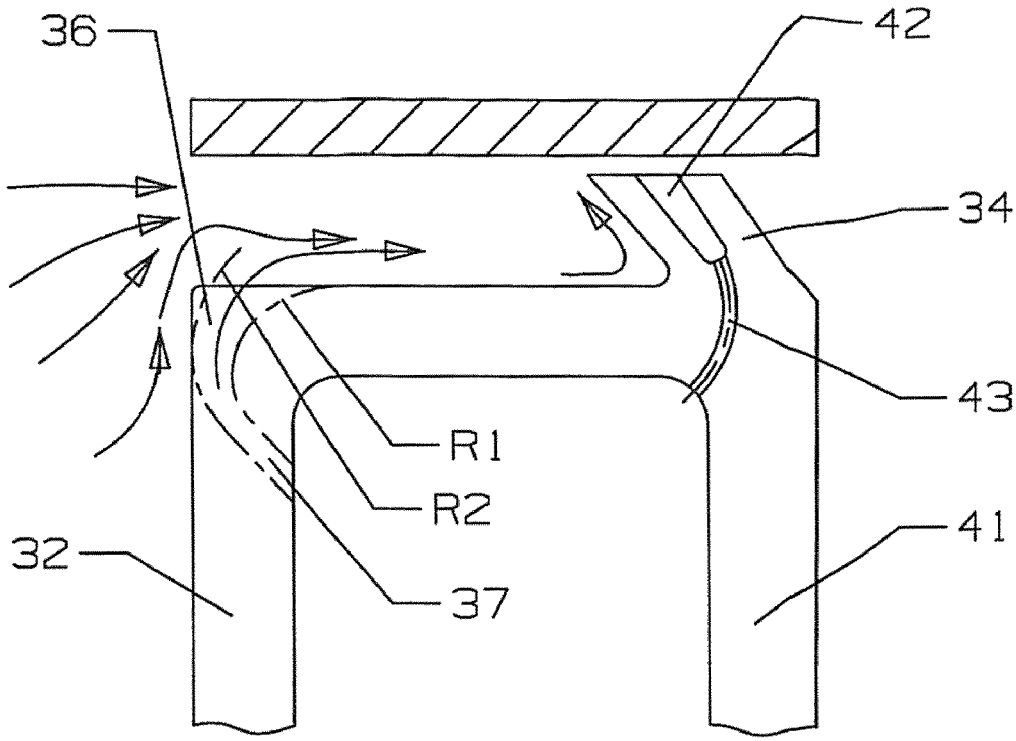
FIG. 8 shows a cross section side view of the blade tip cooling circuit of the present invention with the pressure side wall and the suction side wall and tip rail cooling circuits.

FIG. 8 shows a cross section side view of the blade tip cooling circuit for the present invention. The pressure side wall 32 includes the trench 36 that connects to the metering hole 37 and opens onto the tip edge as seen in FIG. 8. The trench 36 is formed by an upstream or outboard surface with a radius of curvature of R2 and a downstream or inboard surface with a radius of curvature of R1. Each trench 36 opens onto the pressure side wall and the tip floor at the pressure side tip edge.

FIG. 8 also shows the suction side tip rail 34 extending from the blade tip and includes a suction side trench 42 that opens onto the top surface of the tip rail 34 and extends along the entire tip rail as one long open slot. The tip rail trench 42 is connected to the cooling air supply cavity by a row of metering holes 43 that curve toward the forward side of the tip floor. The tip rail 34 includes a forward side wall and an aft side wall that are both slanted toward the forward side of the tip floor as seen in FIG. 8.

Figure 9:
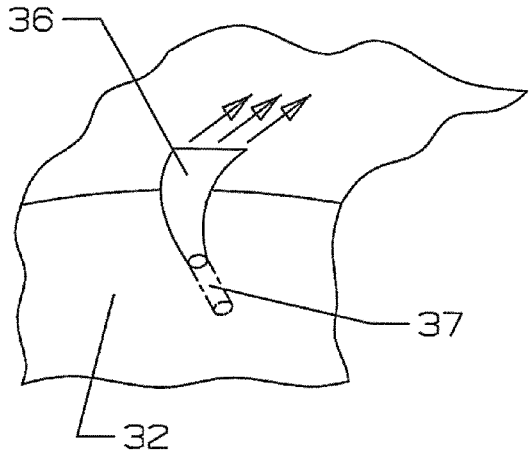
FIG. 9 shows a top view of the cooling hole formed on the pressure side wall tip edge of the present invention.
Figure 10:
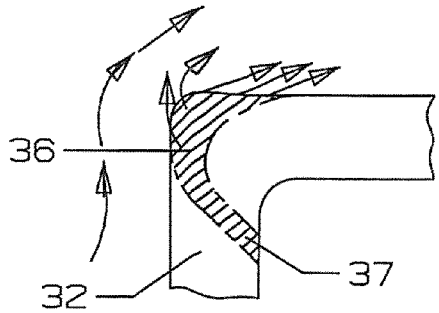
FIG. 10 shows a cross section side view of cooling hole of FIG. 9.
Figure 11:
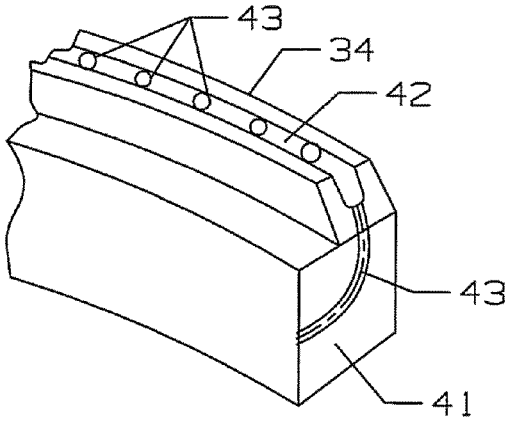
FIG. 11 shows a top view of the suction side tip rail cooling circuit of the present invention.
Figure 12:
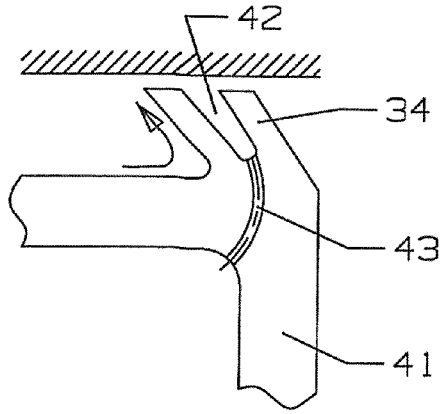
FIG. 12 shows a cross section side view of the tip rail cooling hole of FIG. 11.

FIGS. 9 through 12 show detailed views of the pressure side trench film cooling slots 36 and the suction side tip rail trench. FIG. 9 shows the pressure side trench film cooling slot 36 opening onto the tip floor and the pressure side wall surface. FIG. 10 shows the pressure side trench film cooling slot 36 in a cross section side view in its orientation on the pressure side wall tip edge. FIG. 11 shows a section of the suction side tip rail 34 with the tip rail trench slot 42 opening on the top surface and a row of metering hole 43 that open onto a bottom surface of the tip rail trench slot 34. The metering hole 43 that opens into the tip rail trench slot 42 is shown. FIG. 12 shows a cross section side view of the tip rail 34 with the tip rail trench slot 42 and the metering hole 43 opening onto a bottom surface of the tip rail trench slot 34.

Figure 13:
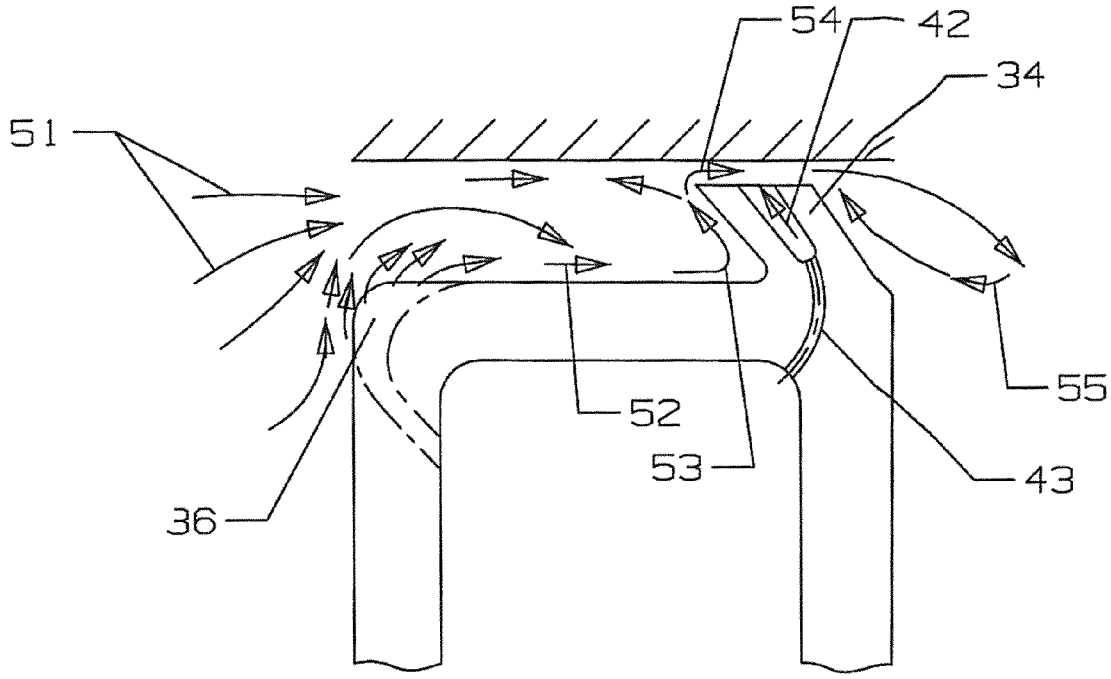
FIG. 13 shows a cross section side view of the blade tip cooling circuit of the present invention with the pressure side cooling hole and the suction side tip rail cooling hole.

FIG. 13 shows a cross section side view of the blade tip and the tip cooling circuit of the present invention with the flow paths for the leakage flow and the tip cooling air that is discharged from the trenches. The blade outer air seal (or, BOAS) interacts with the tip rail and tip floor to form a seal with the blade. The hot gas leakage flow 51 enters the blade tip and is pushed upward by the cooling air discharging from the pressure side trenches 36. The cooling air discharging from the pressure side trenches 36 also forms a layer of film cooling air 52 on the tip floor surface. A vortex pocket 53 is formed on the forward or upstream slanted side wall of the tip rail 34. The flow from the vortex pocket 53 flows up toward the tip rail forward edge and bends toward the BOAS to form a small vena contractor 54 that reduces the leakage flow area between the top surface of the tip rail 34 and the BOAS. The leakage flow that passes through the gap forms a leakage vortex 55 against the aft side of the tip rail on the suction wall side.

The pressure side discrete curved diffusion film cooling holes 36 includes two different radiuses of curvatures. A smaller radius of curvature is used in the inboard surface of the film cooling hole. A larger radius of curvature is used on the outboard surface of the film hole. As a result of this construction, the pressure side periphery film cooling holes include a constant diameter inlet section 37 with an entrance normal to the inner wall to provide metering of the cooling air flow. A one dimensional curved diffusion section with a shallow expansion along the cooling flow direction is produced by the trench slot 36. A large film hole breakout geometry is achieved by this design which yields a better film cooling coverage and film electiveness level than the prior art tip cooling holes.

Since the pressure side film cooling holes are positioned on the airfoil peripheral tip and below the tip periphery trenches, the cooling flow that exits the film hole will be in the same direction of the vortex flow passing over the blade tip from the pressure side wall to the suction side wall. This cooling air flow that is discharged from the cooling is therefore retained longer within the tip peripheral trenches. Also, a newly created film layer within the tip section trenches operates as a heat sink to transfer the tip section heat loads from the tip floor. The tip peripheral trenches also increases the tip section cooling side surface area which reduces the hot gas convection surface area from the tip crown and thus reduces the heat load form the tip floor. The trenches also reduce the effective thickness for the blade pressure side tip corner and therefore increase the effectiveness of the backside convection cooling. The trenches also reduce the blade leakage flow by means of pushing the leakage flow toward the blade outer air seal and thus reduce the effective leakage flow area between the blade suction side tip crown and the BOAS.

On the suction side of the airfoil tip, the suction side tip rail is cooled by the cooling air recirculation within the vortex cooling pocket formed with the airfoil suction wall leakage vortex flow as seen in FIG. 13. Since the single tip rail on the suction side is located on top of the airfoil suction side wall, the tip rail is also cooled by the through-wall conduction of heat load into the convection cooling channel below. Also, a continuous trench slot with metering cooling air discharge holes is formed within the suction side tip rail trench slot to provide additional cooling for the suction side tip rail.

Other than the leakage flow reduction due to the blade end tip geometry effect, the injection of cooling air also impacts on the leakage reduction. Cooling air is pushed into the concave curved surfaces from the pressure side cooling flow and on top of the blade end tip from the cooling channel below. The injection of cooling air into the concave curved surface from the pressure side will accelerate the secondary flow upward and flow forward against the streamwise oncoming leakage flow. The injection of cooling air on top of the suction side end tip surface will flow against the oncoming leakage flow and further push the leakage flow outward toward the blade outer air seal. This injection of cooling air will neck down the vena contractor and reduce the effective flow area. The cooling air injected on top of the end tip will block the oncoming leakage flow and further pinch the vena contractor. As a result of both cooling flow injections, the leakage flow across the blade end tip is further reduced.

On the backside of the blade suction wall end tip, as the leakage flows through the suction wall end tip, a recirculation flow is generated by the leakage on the upper span blade of the suction side wall. Once again, this hot gas recirculation flow will swing upward and follow the backside of the slanted blade end tip and block the oncoming leakage flow and thus reduce the total leakage flow. The creation of this resistance to the leakage flow by the suction side blade end tip geometry and the cooling air flow injection yields a very high resistance fro the leakage flow path and thus reduces the blade leakage flow and the heat load. The blade tip section cooling flow requirement is therefore reduced.

In operation, cooling air is fed into the pressure side curved diffusion cooling metering holes from the blade cooling supply cavity below and then through the curved cooling holes to provide cooling for the blade pressure side tip corner. Since the cooling holes are curved in shape, the cooling air has to change its momentum while flowing through the cooling hole. This change of momentum will generate a high rate of internal heat transfer coefficient within the curved cooling hole so that more heat from the hot metal surface is transferred to the flowing cooling air. Also, the curved cooling holes also discharge the cooling air closer to the airfoil wall than would a straight cooling hole. Due to a pressure gradient across the airfoil from the pressure side to the suction side, the secondary flow near the pressure side surface migrates from the lower blade span upward across the blade end tip. On the pressure side corner of the airfoil, the secondary leakage flow entering the squealer pocket acts like a developing flow at a low heat transfer rate. This leakage flow is pushed upward by the pressure side film cooling flow when it enters the squealer tip channel. The pressure side cooling flow on top of the pressure side tip corner will push the near wall secondary leakage flow outward and against the oncoming streamwise leakage flow. This counter flow action reduces the oncoming leakage flow as well as pushes the leakage outward to the blade outer air seal.

In addition to counter flow action, the vortex convection cooling pocket at the forward face of the suction side tip rail forms a cooling recirculation pocket by the tip rail. The slanted forward blade end tip geometry forces the secondary flow to bend outward and thus yields a smaller vena contractor and subsequently reduces the effective leakage flow area. Furthermore, the injection of cooling air on top of the suction side tip rail further pinches the leakage flow in-between the tip rail and the blade outer air seal. The end result for these combination effects is to reduce the blade leakage flow at the blade tip location. The leakage flow that does flow through the blade end tip to the airfoil suction side wall creates a flow recirculation with the leakage flow.

Major advantages of the sealing and cooling design of the present invention over the prior art squealer tip design are described below. The structure of the blade end tip geometry and cooling air injection induces a very effective blade cooling and sealing for both the pressure and suction side walls. The cooling trenches that open onto the top face of the single suction side tip rail performs like a double tip rail (pressure side and suction side tip rails) sealing for the blade end tip region. A lower blade tip section cooling air demand is achieved due to a lower blade leakage flow. Higher turbine efficiency is achieved due to the low blade leakage flow. Reduction of the blade tip section heat load is achieved due to the low leakage flow which increases the blade useful life.

I claim the following:

1. A turbine rotor blade comprising:

an airfoil with an internal cooling air supply channel;

the airfoil having a pressure side wall and a tip floor forming a pressure side tip edge;

a row of trench film slots opening onto the pressure side tip edge;

the trench film slots extending along the pressure side wall and onto the tip floor;

the row of trench film slots each having two side walls that curve in a direction of a trailing edge of the airfoil; and, each trench film slot including an inlet metering hole connected to the internal cooling air supply channel.

2. The turbine rotor blade of claim 1, and further comprising:

a curvature of the leading edge side wall of the trench film slot being greater than a curvature of the trailing edge side wall of the trench film slot.

3. The turbine rotor blade of claim 1, and further comprising:

the row of trench film slots extends along the entire pressure side wall edge of the airfoil.

4. The turbine rotor blade of claim 1, and further comprising:

each trench film slot includes an inboard curved surface and an outboard curved surface where the radius of curvature of the inboard surface is less than the radius of curvature of the outboard surface.

5. The turbine rotor blade of claim 4, and further comprising:

the inboard curved surface of the trench film slot merges in a smooth transition to the tip floor of the blade.

6. The turbine rotor blade of claim 4, and further comprising:

the outboard curved surface of the trench film slot is directed to push a hot gas flow up and over the tip corner on the pressure wall side.

7. The turbine rotor blade of claim 1, and further comprising:

the blade tip includes a tip rail on the suction side wall of the blade;

the tip rail includes a slot opening on a top surface of the tip rail;

the tip rail slot extending along an entire length of the tip rail; and, a row of metering and cooling holes connecting the internal cooling air supply channel to the tip rail slot.

8. The turbine rotor blade of claim 7, and further comprising:

the tip rail includes a slanted forward side wall and a slanted aft side wall in which both slant toward the pressure side of the blade tip.

9. The turbine rotor blade of claim 7, and further comprising:

the row of metering and cooling holes are curved cooling holes with a curvature toward the pressure side of the blade tip.

10. The turbine rotor blade of claim 7, and further comprising:

the tip rail is flush with a suction side wall of the blade.

11. The turbine rotor blade of claim 1, and further comprising:

the tip rail includes a slanted forward side wall that forms a vortex pocket for a layer of film cooling air ejected from the trench film cooling slots.

12. The turbine rotor blade of claim 8, and further comprising:

the slanted aft side of the tip rail forms a vortex flow of the leakage flow over the tip rail.

13. A turbine rotor blade comprising:

a pressure side wall and a suction side wall;

a tip floor extending from the pressure side wall and forming a pressure side tip corner with the pressure side wall;

a tip rail extending along the suction side wall;

a tip rail slot opening onto a top surface of the tip rail and extending an entire length of the tip rail; and, a row of metering and cooling holes opening into the tip rail slot.

14. The turbine rotor blade of claim 13, and further comprising:

the tip rail having a forward side with a slant toward the pressure side of the blade tip and forming a vortex pocket.

15. The turbine rotor blade of claim 13, and further comprising:

the row of metering and cooling holes having a curvature in a direction toward the pressure side of the blade tip.

16. The turbine rotor blade of claim 14, and further comprising:

the tip rail having a slanted aft side flush with the suction side wall of the blade and that forms a vortex flow of the leakage flow over the tip rail.

* * * * *